US010954577B2

(12) United States Patent
Frost et al.

(10) Patent No.: US 10,954,577 B2
(45) Date of Patent: Mar. 23, 2021

(54) HOT-FORMING LINE FOR MANUFACTURING HOT-FORMED AND PRESS-HARDENED STEEL-SHEET PRODUCTS, AND METHOD FOR OPERATING SAID HOT-FORMING LINE

(71) Applicant: Benteler Automobiltechnik GmbH, Paderborn (DE)

(72) Inventors: Georg Frost, Steinheim (DE); Martin Hesselmann, Willebadessen (DE); Markus Kettler, Paderborn (DE); Christoph Nitschke, Paderborn (DE)

(73) Assignee: BENTELER AUTOMOBILTECHNIK GMBH, Paderborn (DE)

( * ) Notice: Subject to any disclaimer, the term of this patent is extended or adjusted under 35 U.S.C. 154(b) by 624 days.

(21) Appl. No.: 15/389,556

(22) Filed: Dec. 23, 2016

(65) Prior Publication Data

US 2017/0183755 A1 Jun. 29, 2017

(30) Foreign Application Priority Data

Dec. 23, 2015 (DE) ..... 10 2015 122 796.7

(51) Int. Cl.

| | |
|---|---|
| ***B21D 43/05*** | (2006.01) |
| ***C21D 9/46*** | (2006.01) |
| ***C21D 9/48*** | (2006.01) |
| ***C21D 9/00*** | (2006.01) |
| ***C21D 1/18*** | (2006.01) |
| ***B21D 22/02*** | (2006.01) |
| ***C21D 1/34*** | (2006.01) |

(Continued)

(52) U.S. Cl.

CPC ..... *C21D 9/46* (2013.01); *B21D 22/022* (2013.01); *B21D 43/05* (2013.01); *C21D 1/18* (2013.01); *C21D 1/34* (2013.01); *C21D 1/673* (2013.01); *C21D 8/005* (2013.01); *C21D 9/0018* (2013.01); *C21D 9/0056* (2013.01); *C21D 9/48* (2013.01); *C21D 2221/00* (2013.01)

(58) Field of Classification Search

CPC .... B21D 22/022; B21D 43/05; B21D 43/052; B21D 43/055

See application file for complete search history.

(56) References Cited

U.S. PATENT DOCUMENTS

| | | | |
|---|---|---|---|
| 5,737,960 | A | 4/1998 | Brandstetter et al. |
| 6,176,365 | B1 | 1/2001 | Klemm |

(Continued)

FOREIGN PATENT DOCUMENTS

| | | | |
|---|---|---|---|
| CH | 698129 | B1 | 5/2009 |
| CN | 1871078 | A | 11/2006 |

(Continued)

OTHER PUBLICATIONS

Chinese Office Action for 201611273112.X dated Mar. 5, 2018; 16 pp.

*Primary Examiner* — Debra M Sullivan

(74) *Attorney, Agent, or Firm* — Hauptman Ham, LLP

(57) ABSTRACT

A hot-forming line and a method for operating the hot-forming line is disclosed having a temperature-control station and a hot-forming and press-hardening tool. A linear conveyor system for conveying the metal blank or the formed steel-sheet products, respectively, through the hot-forming line is provided.

16 Claims, 9 Drawing Sheets

(51) Int. Cl.
*C21D 1/673* (2006.01)
*C21D 8/00* (2006.01)

(56) References Cited

U.S. PATENT DOCUMENTS

| | | | | |
|---|---|---|---|---|
| 7,690,238 | B2 | 4/2010 | Shiroza | |
| 2008/0034988 | A1 | 2/2008 | Shiroza | |
| 2011/0283851 | A1* | 11/2011 | Overrath | B21D 22/00 83/15 |
| 2014/0124104 | A1* | 5/2014 | Trippe | B21D 22/022 148/566 |
| 2016/0076116 | A1 | 3/2016 | Baettenhausen et al. | |
| 2017/0066030 | A1* | 3/2017 | Frost | B21D 37/16 |

FOREIGN PATENT DOCUMENTS

| | | | |
|---|---|---|---|
| DE | 195 42 205 | A1 | 5/1997 |
| DE | 19542205 | A1 | 5/1997 |
| DE | 19652709 | A1 | 6/1998 |
| DE | 100 62 332 | A1 | 6/2002 |
| DE | 195 06 070 | B4 | 7/2004 |
| DE | 19506070 | B4 | 7/2004 |
| DE | 11 2004 002 021 | B4 | 5/2009 |
| DE | 112004002021 | B4 | 5/2009 |
| DE | 10 2009 014 670 | B4 | 1/2011 |
| DE | 102009014670 | B4 | 1/2011 |
| DE | 102013104229 | B3 | 10/2014 |
| EP | 0849014 | B1 | 3/2001 |

* cited by examiner

HOT-FORMING LINE FOR MANUFACTURING HOT-FORMED AND PRESS-HARDENED STEEL-SHEET PRODUCTS, AND METHOD FOR OPERATING SAID HOT-FORMING LINE

CROSS-REFERENCE TO RELATED APPLICATIONS

The present application claims priority to German Application Number 10 2015 122 796.7 filed Dec. 23, 2015, the disclosure of which is hereby incorporated by reference herein in its entirety.

FIELD

The present invention relates to a hot-forming line for manufacturing hot-formed and press-hardened steel-sheet products.

The present invention furthermore relates to a method for operating a hot-forming line.

BACKGROUND

Manufacturing steel-sheet products by means of hot-forming and press-hardening is known from the prior art. To this end, a metal blank form a hardenable steel alloy is heated at least in regions to a temperature above the austenitizing temperature. Subsequent to heating, the metal blank in this warm state is placed into a hot-forming tool and hot-formed. Upon termination of the hot-forming process, the formed component in the hot-forming tool is rapidly cooled in such a manner that hardening of the material microstructure is initiated. This is referred to as a press-hardening procedure.

Consequently, a heating station, also referred to as a temperature-control station, and a hot-forming and press-hardening tool are required for carrying out such a production procedure. Manipulators, in most instances in the form of industrial robots, are employed between the individual stations or tools, respectively, in order for the blank or the components, respectively, to be transferred from one station to the next.

Such a hot-forming line is known, for example, from DE 10 2009 014 670 B4.

SUMMARY

It is an object of the present invention to provide a hot-forming line and a method for operating the same, in which the transportation time between the various stations, and the constructive effort for transportation are optimized.

The hot-forming line for manufacturing hot-formed and press-hardened steel-sheet products has at least one temperature-control station for heating at least one metal blank, and at least one hot-forming and press-hardening tool for forming and hardening the heated metal blank to a steel-sheet product. Said hot-forming line according to the invention is distinguished in that a linear conveyor system which is configured from two mutually opposite parallel rails is provided along the hot-forming line, wherein the rails per se are displaceable in a translatory manner, and gripper elements, hereunder also referred to as grippers, are disposed on the rails, wherein the gripper elements are displaceable in the axial direction of the rails, and the gripper elements are capable of being lifted and lowered, respectively, in a manner orthogonal to the rails or conjointly therewith. There may also be two rails disposed per side. Herein, the displacement of the gripper elements in the axial direction of the rails may be performed either by a displacement of the rails in the axial direction, or else by way of a movement of the gripper elements relative to the rails. The linear conveyor system is thus provided at least across a part-length of the hot-forming line such that blanks may be transported from the temperature-control station up to the hot-forming tool, or the press-hardening tool, respectively. The linear conveyor system is preferably provided along the entire hot-forming line.

The linear conveyor system is thus provided along the entire hot-forming line. Therefore, a metal blank is received from a blank stack, or a blank that is provided by a trimming installation is received and transported through the hot-forming line, and the finished steel-sheet product is deposited at a depository. Separate manipulators, in particular industrial robots, between the individual stations may thus be dispensed with. On account thereof, the individual stations of the hot-forming line may be physically moved closer together according to the invention, or else be directly adjacent in a mutually contiguous manner. On account thereof, the space required for setting up such a hot-forming line in a factory shed is reduced.

In particular, the linear conveyor system may furthermore be operated in a synchronous manner with a plurality of gripper elements, in particular so as to be synchronous with the cycle time of the hot-forming line. On account thereof, it is possible for the cycle times of the entire hot-forming line to be optimized, in particular to be shortened, and for the transfer times to be reduced. The power required for operating the linear conveyor system as well as for heating the blank and/or keeping the blank warm, for example, may also be reduced. The cycle time is preferably equal to or less than 10 s. The cycle time for temperature controlling may preferably be equal to or less than 6 s, in particular less than or equal to 4 s. The cycle time for hot-forming and press-hardening is preferably less than or equal to 6 s, in particular between 4 s and 6 s.

The linear conveyor system according to the invention is particularly suitable for a hot-forming line with multiple parallel action, in particular for a hot-forming line having a dual or quadruple or even quintuple parallel action. In the context of the invention, this means that two metal blanks are received in parallel and are placed into the temperature-control station in parallel. Subsequently thereto, the two metal blanks that have at least been partially heated in the temperature-control station are again received in parallel and placed into a hot-forming and press-hardening tool in parallel. The hot-forming and press-hardening tool has two shape-imparting cavities such that the two at least partially heated metal blanks are conjointly hot-formed in parallel and are also press-hardened in parallel. The two steel-sheet products that are manufactured on account thereof are then received in parallel and deposited onto a depository stack.

In particular, hardened steel-sheet products for the automotive industry, for example structural motor-vehicle parts or motor-vehicle body parts, are manufactured.

The linear conveyor system is particularly preferably furthermore distinguished in that active grippers are provided for acquiring a metal blank. The active grippers carry out a clamping movement. In particular, said active grippers are provided as scissor-type grippers, for example. In particular, the active grippers are configured as blank grippers and temperature-control grippers, particularly preferably at least as a gripper pair on the two mutually opposite parallel rails, wherein in each case one gripper of the gripper pair is disposed on one of the two mutually opposite parallel rails. Thus, reliable transportation may be enabled by the clamping movement of the active gripper in the case of a blank which by virtue of the gravitational force of the earth sags in the lifted state.

Passive grippers are preferably provided for acquiring a finished steel-sheet product. In particular, passive grippers acquire the steel-sheet product from below in relation to the vertical direction, lifting said steel-sheet product. By virtue of the influence of gravity, the steel-sheet product remains so as to lie on the passive gripper. In particular, the passive grippers are configured as product grippers. Herein, the steel-sheet product has a higher modulus of resistance to sagging, wherein a passive gripper is also less complex in terms of construction in relation to an active gripper and thus is less susceptible to defects. The grippers elements, but in particular the passive grippers, are disposed below the component, in order for the latter to be acquired.

The gripper elements described above are disposed on the rails. Depending on the variant of design embodiment of the rails per se, this means that said gripper elements slide across the rails from the outside, or else are disposed within the rails. In particular, the gripper elements are coupled to the rails in such a manner that said gripper elements may carry out a movement in the axial direction of the rails, on the one hand, but are simultaneously guided in a linear manner.

The rails per se may be manufactured as an extruded profiled section. The gripper elements may be mounted in or on the rails, for example by way of ball bearings or roller bearings. However, said gripper elements may also be coupled to the rails by way of a friction bearing. Preferably, all gripper elements are displaceable in the axial direction of the rails by way of a synchronous drive.

The movement of the gripper elements in the axial direction may thus be carried out in a synchronous manner and therefore at the same cycle rate. The synchronous drive herein may be a rack-and-pinion drive or else a belt drive.

Alternatively, the gripper elements may also be locationally fixed to the rails in relation to the axial direction of the latter. This means that any movement of the rails in the axial direction thereof also leads to the gripper elements being moved in the axial direction. The rails in this instance are likewise moved in the longitudinal direction thereof by way of a synchronous drive.

In one further preferred variant of design embodiment, the main movement of the gripper elements for transportation is performed by a movement of the rails in the longitudinal direction of the latter. To this end, it is possible for at least two gripper pairs, therefore for two grippers that on one rail are spaced apart in the longitudinal direction, are modifiable in terms of the relative mutual spacing therebetween in the longitudinal direction of the rails. The grippers therefore carry out a relative movement in the longitudinal direction of the rails such that a mutually dissimilar spacing of two blanks that are received from a temperature-control station for depositing in a forming tool may be set, for example. However, the main transportation movement is carried out by the movement of the rails in the longitudinal direction.

However, the gripper elements are furthermore preferably displaceable relative to the rails in relation to the vertical direction. Here too, it is possible for the gripper elements to be lifted or lowered relative to the rails in relation to the vertical direction by way of an electric, hydraulic, pneumatic, or else a belt drive, therefore by way of a mechanical drive. Also preferably, it is again possible herein for the gripper elements to be likewise locationally fixed to the rails in relation to the vertical direction. A lifting movement of the blanks or steel-sheet products, respectively, is thus performed by lifting the entire rails in the vertical direction.

Furthermore preferably, the rails are displaceable in a manner orthogonal to the axial direction thereof, and outwardly in relation to the hot-forming line. This may likewise be performed by way of a synchronous drive such that both rails are each simultaneously moved outward, therefore carrying out opposing movements. The placed metal blanks, and the heated metal blanks that are placed into the hot-forming and press-hardening tool, then may be processed in the respective station, preferably in one cycle. If and when processing, therefore the cycle, is terminated, the temperature-control station and the hot-forming and press-hardening tool are opened, and the rails are inwardly displaced, carrying out a converging movement. Metal blanks or steel-sheet products, respectively, may then be received by the gripper elements. Subsequently, the gripper elements carry out the movement in the axial direction of the rails.

A translatory displacement path of the rails in the horizontal plane orthogonal to the longitudinal direction, from a resting position to a gripping position, herein is preferably only between 5 mm and 250 mm, preferably 10 mm to 50 mm. By the particularly short time by virtue of the minor displacement path of the rails per se, the time required for conveying is in turn significantly shortened in relation to that of an industrial robot. On account thereof, the cycle times between press cycles may be reduced, and the power required for deploying the movement may be likewise reduced.

Furthermore particularly preferably, the temperature-control station and the press frame having hot-forming and press-hardening tools are disposed close to one another. In the context of the invention, this means that the spacing between the press frame and the temperature-control station is less than 2 m, preferably less than 1 m, in particular less than 50 cm. Particularly preferably however, said press frame and said temperature-control station are configured so as to be directly mutually contiguous. This means that the spacing is a few centimeters, or else configured so as to be directly next to one another. Therefore, the spacing is less than 10 cm, in particular less than 5 cm remaining such that the hot-forming and press-hardening tool is decoupled from the temperature-control station. The decoupling refers in particular to vibrations and temperature conductors and to kinematic motion sequences. In particular, a total length of less than 15 m, in particular less than 10 m, in the longitudinal direction of the rails, therefore in the horizontal direction of the overall displacement path from receiving the blank up to depositing the manufactured component, may be realized by way of the linear conveyor system according to the invention. Thus, approx. 2 m are used for the temperature-control station, 2.2 m for the press frame of the hot-forming and press-hardening tool, 1 m each for the inlet and the outlet, and the remaining available space in the longitudinal direction is used for the receptacle container for temperature controlling and forming provided blanks, and for a depository container for depositing completed components. These details refer in each case to a dual parallel-action embodiment of the temperature-control station and of the hot-forming tool. The temperature-control station and the hot-forming and press-hardening tool are preferably disposed on separate machine foundations. The advantage results that comparatively small standard presses may be used both for the temperature-control station as well as for the hot-forming and press-hardening tool. For example, a press having a pressing force of 1500 to 2500 t, in particular 1800 to 2200 t, and preferably 2000 t may be used for the hot-forming and press-hardening tool. A press having a pressing force of 20 to 100 t, in particular 30 to 70 t, preferably 50 t may be used for the temperature-control station.

In one further preferred variant of design embodiment it is however possible for the temperature-control station to be coupled directly to the hot-forming and press-hardening tool. In particular, the temperature-control station is flange-fitted to the press frame. Moreover, it is possible for the temperature-control station to be actuated in parallel with the drive of the hot-forming and press-hardening tool, and for both stations to operate in a synchronous manner, or at the same cycle rate, respectively. To this end, the temperature-control station may in particular have the same controller, preferably also the same drive, as the hot-forming and press-hardening tool in the press frame.

In particular, it is thus possible for the temperature-control station and the hot-forming and press-hardening tool to be opened and closed, respectively, in a synchronous manner by way of the same drive. The opening and closing movements, respectively, are thus performed at the same press cycle rate. Alternatively, it is also advantageous for the temperature-control station to be opened in a temporally delayed manner in relation to the hot-forming and press-hardening tool, or so as to be trailing the cycle of the latter, respectively. In particular, an improved thermal action results in the case of contact heating by bearing on temperature-control plates, or a lower cooling rate results after the temperature-control station has been opened, respectively. The temperature-control station is thus opened only once the hot-forming tool has been opened, or shortly prior to the commencement of the transportation of the heated blanks into the hot-forming tool, respectively.

The present invention furthermore relates to a method for operating the hot-forming line described above. To this end, a blank is acquired and by way of an axial movement of at least two mutually opposite blank grippers is conveyed into the temperature-control station and is deposited therein. Parallel therewith, a heated metal blank in the temperature-control station is acquired by at least two mutually opposite temperature-control grippers and is conveyed into the hot-forming and press-hardening tool and is deposited therein. Again parallel therewith, a formed and hardened steel-sheet product from the hot-forming and press-hardening tool is acquired by at least two mutually opposite product grippers and conveyed to a depository stack, or the manufactured steel-sheet products are conveyed by a downstream transfer system to the depository stack.

Further advantages, features, properties, and aspects of the present invention are the subject matter of the following description explained. Preferred variants of design embodiment are illustrated in the schematic figures. The latter assist in readily understanding the invention. In the figures:

BRIEF DESCRIPTION OF THE DRAWINGS

For an understanding of embodiments of the disclosure, reference is now made to the following description taken in conjunction with the accompanying drawings, in which.

In the figures, the same reference signs are used for identical or equivalent components, even if and when a repeat description is dispensed with for reasons of simplification.

DETAILED DESCRIPTION

Figure 1:
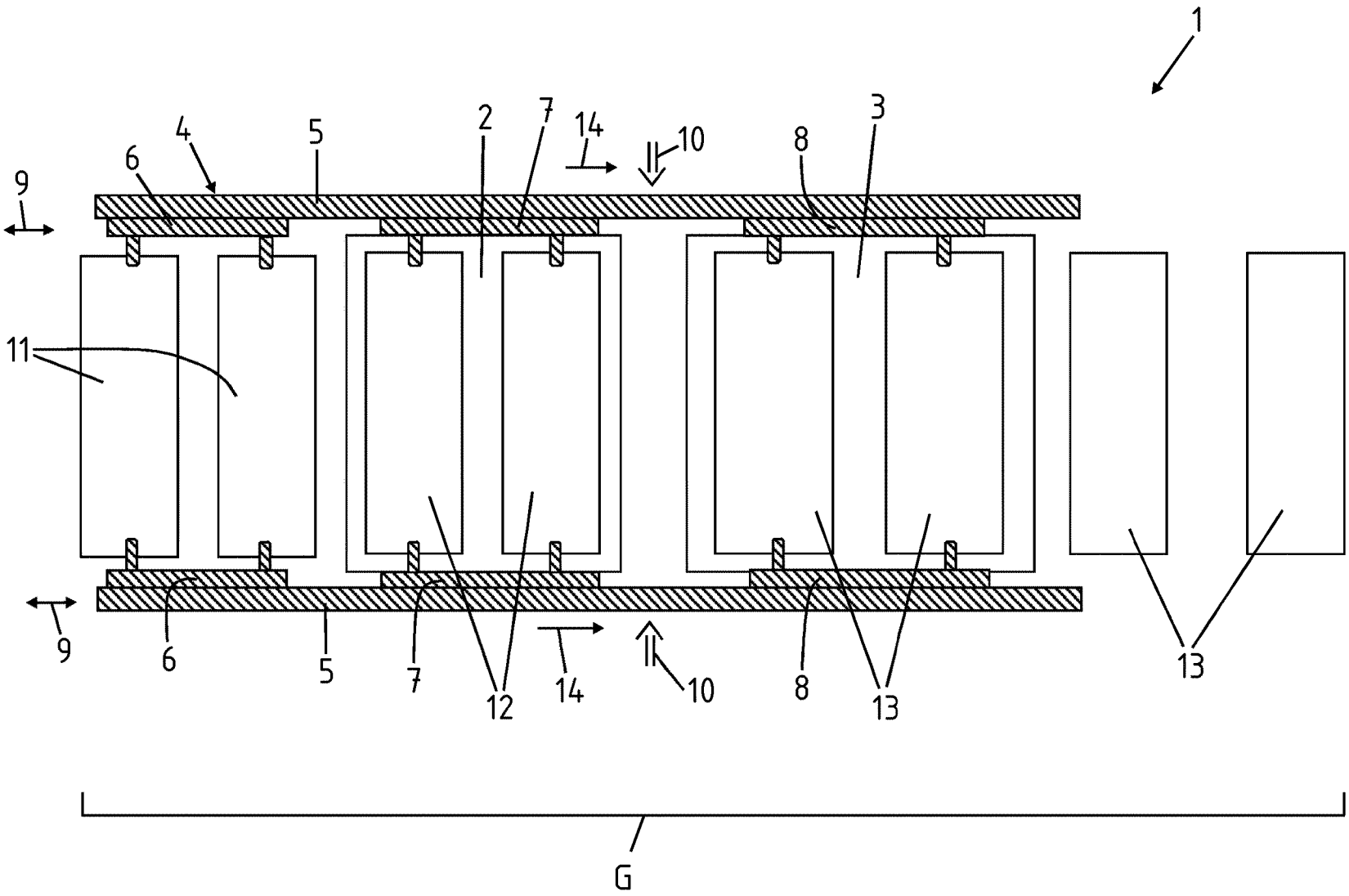
FIGS. 1 to 3 show the course of the method of a hot-forming line according to the invention.

FIG. 1 shows a hot-forming line 1 according to the invention, having a temperature-control station 2, and a hot-forming and press-hardening tool 3, and linear conveyor system 4 disposed thereon. The linear conveyor system 4 has two rails 5, disposed so as to be mutually parallel, wherein gripper elements are disposed on the rails 5. Two blanks grippers 6 are disposed from left to right in relation to the image plane. Two temperature-control grippers 7 are disposed in the center in relation to the image plane, and two product grippers 8 are disposed on the right side in relation to the image plane. The hot-forming line 1 thus has a dual parallel action. Said hot-forming line 1 may also be configured so as to have a single action, a tripe parallel action, a quadruple parallel action, or a multiple parallel action. An overall displacement path 6 is furthermore illustrated.

According to the variant presently illustrated, the gripper elements are locationally fixed to the rails 5 in relation to the axial direction 9 of the rails 5, wherein the rails 5 are movable in the axial direction 9 thereof. Alternatively, it would also be conceivable for the gripper elements to be displaceable in the axial direction 9 in relation to the rails 5.

It is furthermore illustrated that the rails 5 have carried out a relative movement 10 in an inward orthogonal manner in relation to the axial direction 9 of the former. The respective gripper elements have thus been brought to engage with the metal blanks 11, the metal blanks 12 to be heated, and the steel-sheet products 13, respectively.

Figure 2:
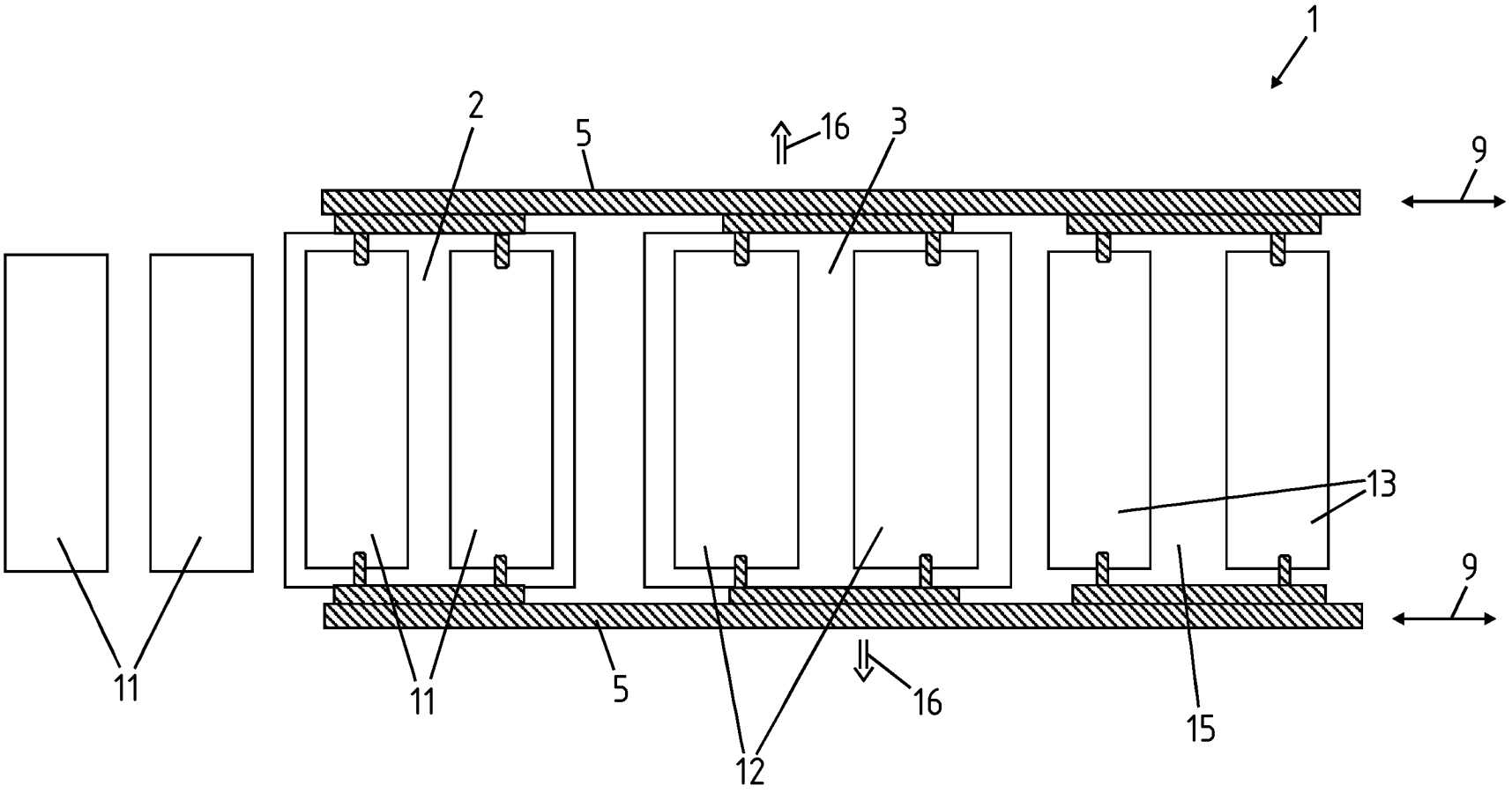

The linear conveyor system 4 then carries out a transportation movement 14 in the axial direction 9 of the rails 5. The terminal position is illustrated in FIG. 2. The formed steel-sheet products 13 are deposited onto a schematically illustrated depository stack 15. The heated metal blanks 13 are deposited onto the hot-forming and press-hardening tool 3. The freshly received metal blanks 11 are deposited onto the temperature-control station 2, and fresh metal blanks 11 are in turn offered up. Subsequently, an outward movement 16 is carried out by the rails 5 such that the entire rails 5 having the respective gripper elements are moved outward in relation to the axial direction 9 of the rails 5, so as to no longer be engaged with the metal blanks 11, 12, and the steel-sheet products 13.

Figure 3:
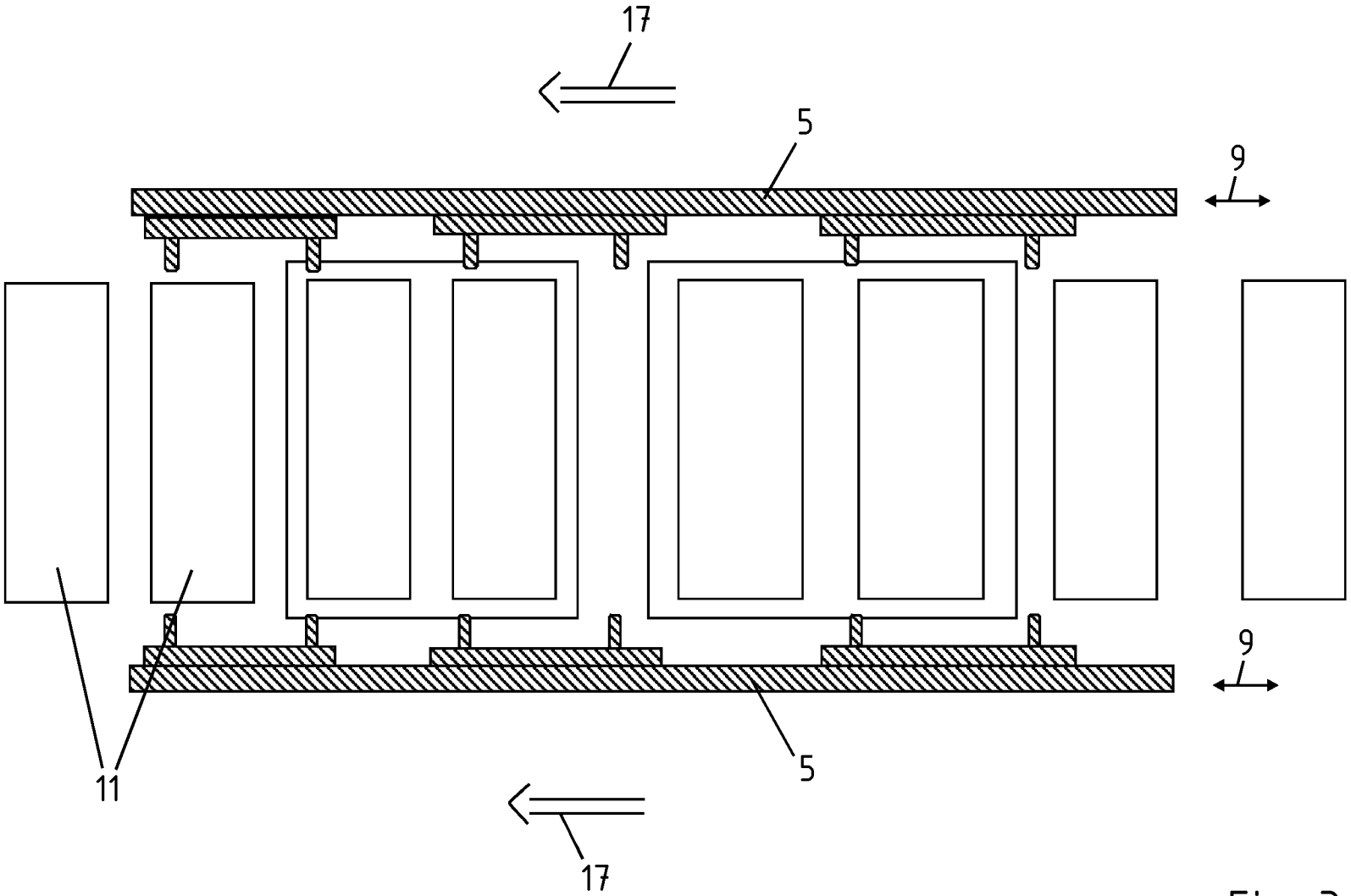

Thereupon, a return movement 17 is carried out in the axial direction 9 of the rails 5, this return movement 17 in particular being carried out by both rails 5 in a synchronous manner, as is shown in FIG. 3. Thereafter, the procedure recommences, as is illustrated in FIG. 1. The returned rails 5 are converged such that the gripper elements are brought to engage with the heated metal blanks 12 and the steel-sheet products 13.

Figure 4A:
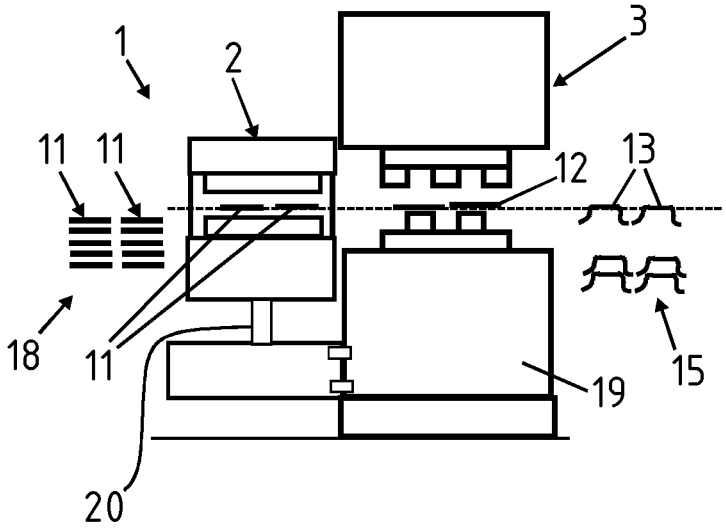
FIGS. 4*a* and 4*b* show a hot-forming and press-hardening tool having a temperature-control station that is laterally flange-fitted to the former.
Figure 4B:
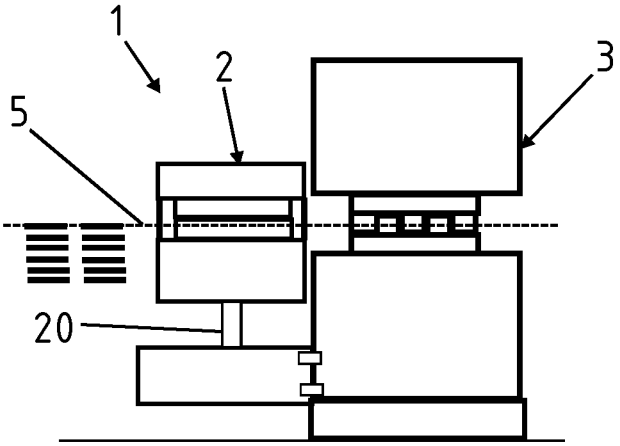

FIGS. 4*a* and 4*b* each show the hot-forming line 1 according to the invention in a side view. The rails 5 can be seen. Metal blanks 11 that have been received by a metal-blank stack 18 are infed to the temperature-control station 2. The temperature-control station 2 herein is optionally flange-fitted to the press frame 19. According to FIG. 4*b*, the hot-forming and press-hardening tool 3 and the temperature-control station 2 have carried out a closing movement in a synchronous manner, heating the metal blanks 11 that are placed into the temperature-control station 2, and forming the heated metal blanks 12 to the steel-sheet products 13 which are stored on a depository stack 15. The temperature-control station 2 herein has an actuator 20 such that the temperature-control station 2 may be actuated independently of the hot-forming and press-hardening tool 3. The actuator 20 may be disposed on top of or below the temperature-control station 2.

Figure 5:
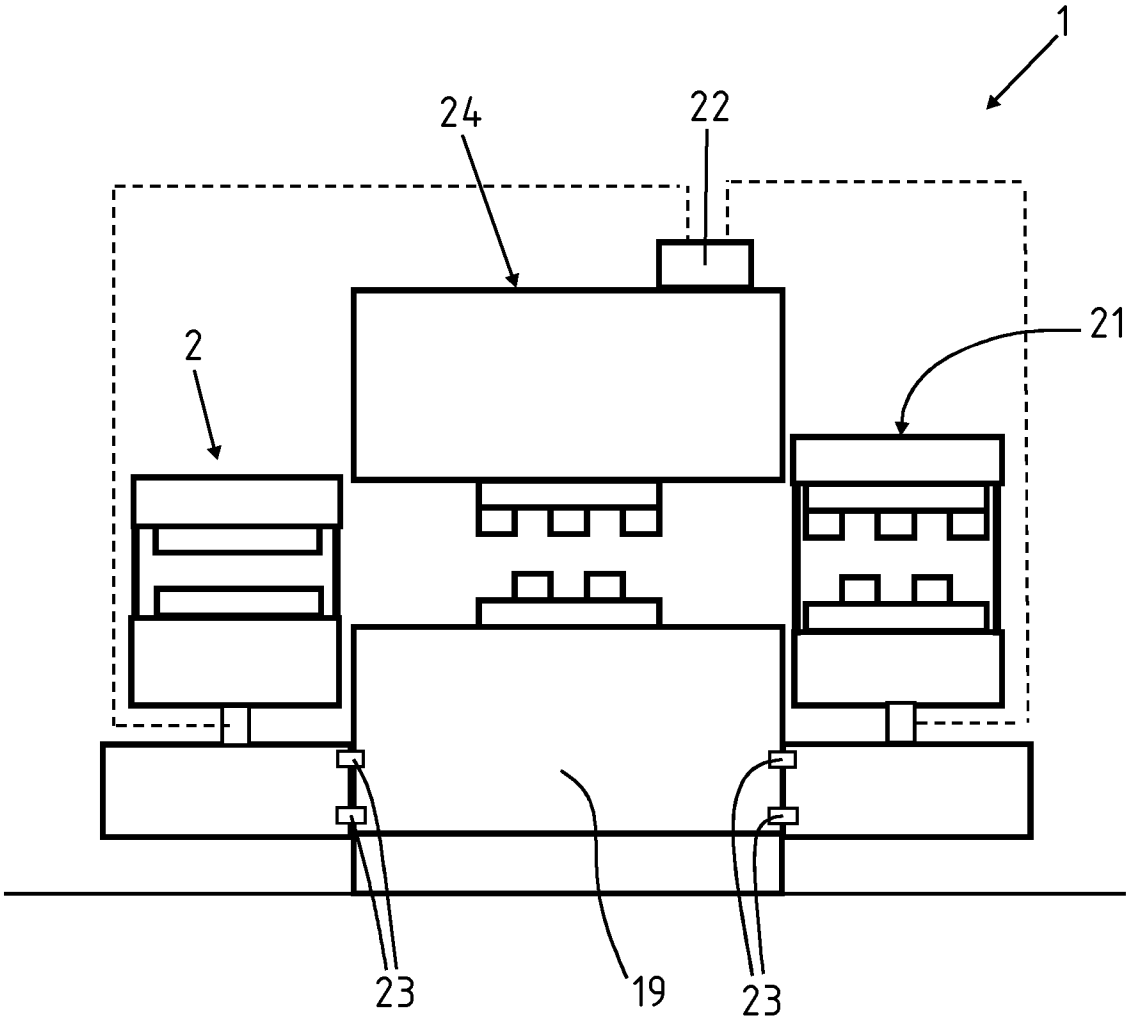
FIG. 5 shows a hot-forming and press-hardening tool having temperature-control stations that are laterally flanged to the former.

FIG. 5 shows an alternative variant of design embodiment of the hot-forming line 1, having a hot-forming and press-hardening tool and a separate downstream temperature-control station 21, the temperature-control station 21 and the hot-forming and press-hardening tool 24 being connected to a common control unit 22. One control unit 22 herein actuates all individual stations in a synchronous-cycle manner, or even a simultaneous manner. Vibration dampers 23 may preferably be employed in the coupling in the case of all constructive units that are illustrated in the figures. The temperature-control station 21 serves for the localized softening or another localized setting of the microstructure of the press-hardened steel-sheet product.

Figure 6:
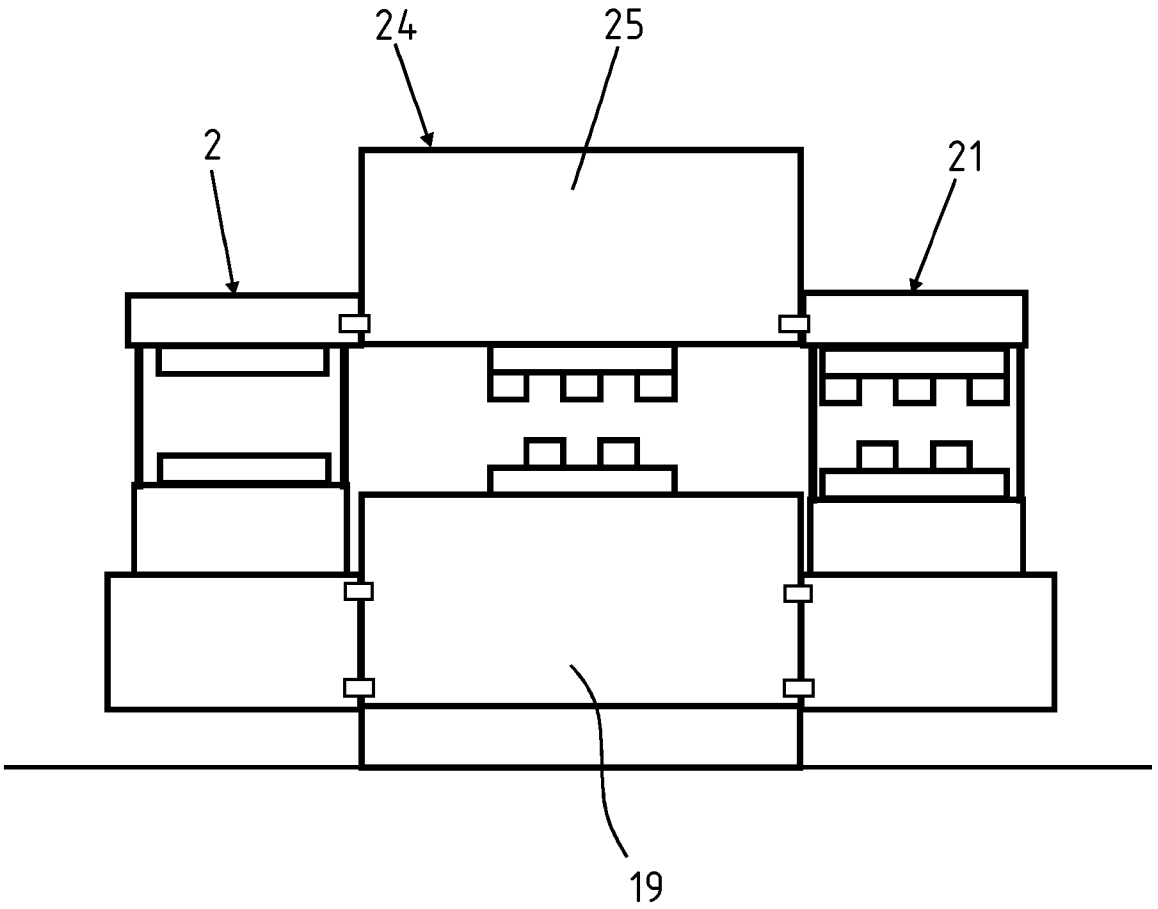
FIG. 6 shows a hot-forming and press-hardening tool as per FIG. 5, in an alternative variant of design embodiment.

FIG. 6 shows a variant of design embodiment according to FIG. 5, the point of difference being that the temperature-control station 2 and the temperature-control station 21 are coupled to an upper tool 25 of the hot-forming and press-hardening tool 24, or to the press frame 19 thereof, respectively, such that the opening and closing movements of the upper tool 25 are carried out so as to be synchronized in terms of the cycle rate and to be simultaneous with those of the temperature-control station 2.

Figure 7A:
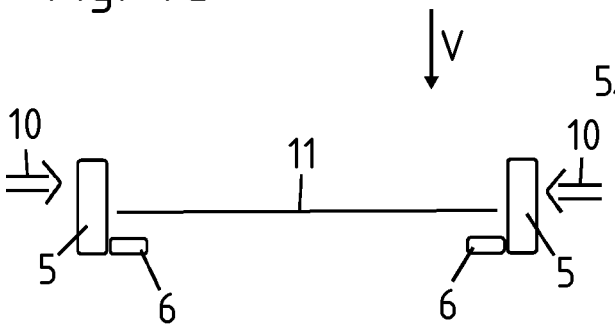
FIGS. 7*a* and 7*b* show a lifting function of a linear conveyor system having fixed gripper elements.
Figure 7B:
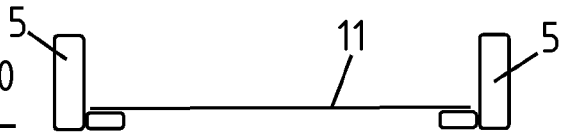

FIGS. 7*a* and 7*b* show a lifting procedure of the rails 5 having the blank grippers 6. The rails 5 have carried out a converging movement 10 in a manner orthogonal to the axial direction 9 of said rails 5, such that the blank grippers 6 are located below the metal blank 11 in relation to the vertical direction V. Subsequently thereto, a lifting movement is carried out by the rails 5, as is illustrated in FIG. 7*b*. This means that the entire rails 5 are moved upward in the vertical direction V. The metal blank 11, as it were, bears on the blank grippers 6 and is likewise lifted.

Figure 8A:
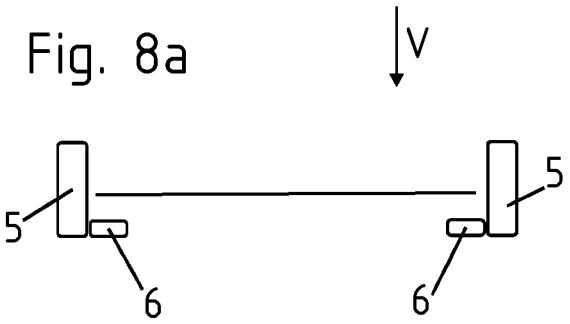
FIGS. 8*a* and 8*b* shows a lifting function of a linear conveyor system having gripper elements which are movable relative to one another.
Figure 8B:
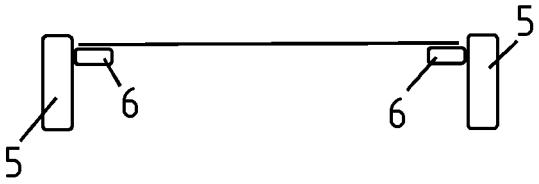

FIGS. 8*a* and 8*b* show a variant of design embodiment that is an alternative to the above. Herein, not the rails 5 but only the blank grippers 6 are lifted in relation to the vertical direction V. Said blank grippers 6 are thus mounted on the rails 5 so as to be movable relative to the vertical direction V, and may also be lifted or lowered, respectively.

Figure 9A:
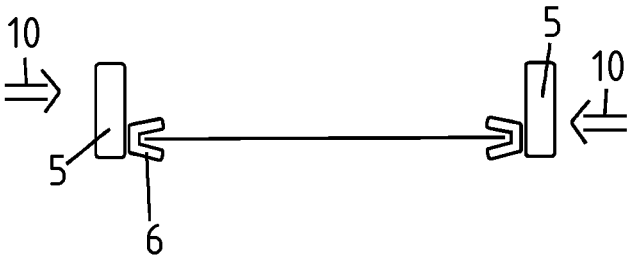
FIGS. 9*a* to 9*c* show active grippers according to the invention.
Figure 9B:
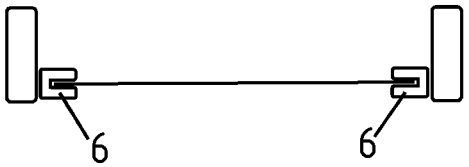
Figure 9C:
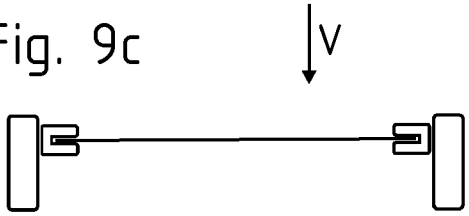

FIGS. 9*a* to 9*c* show a relative movement 10 that is analogous to that of FIGS. 8*a* and 8*b*, the point of difference being that the blank grippers 6 are presently illustrated as active grippers. The latter are shown in an open position according to FIG. 9*a*, such that the rails 5 have carried out a converging movement 10. According to FIG. 9*b*, the blank grippers 6 as active grippes are then closed, and according to FIG. 9*c* are again lifted in relation to the vertical direction V.

Figure 10:
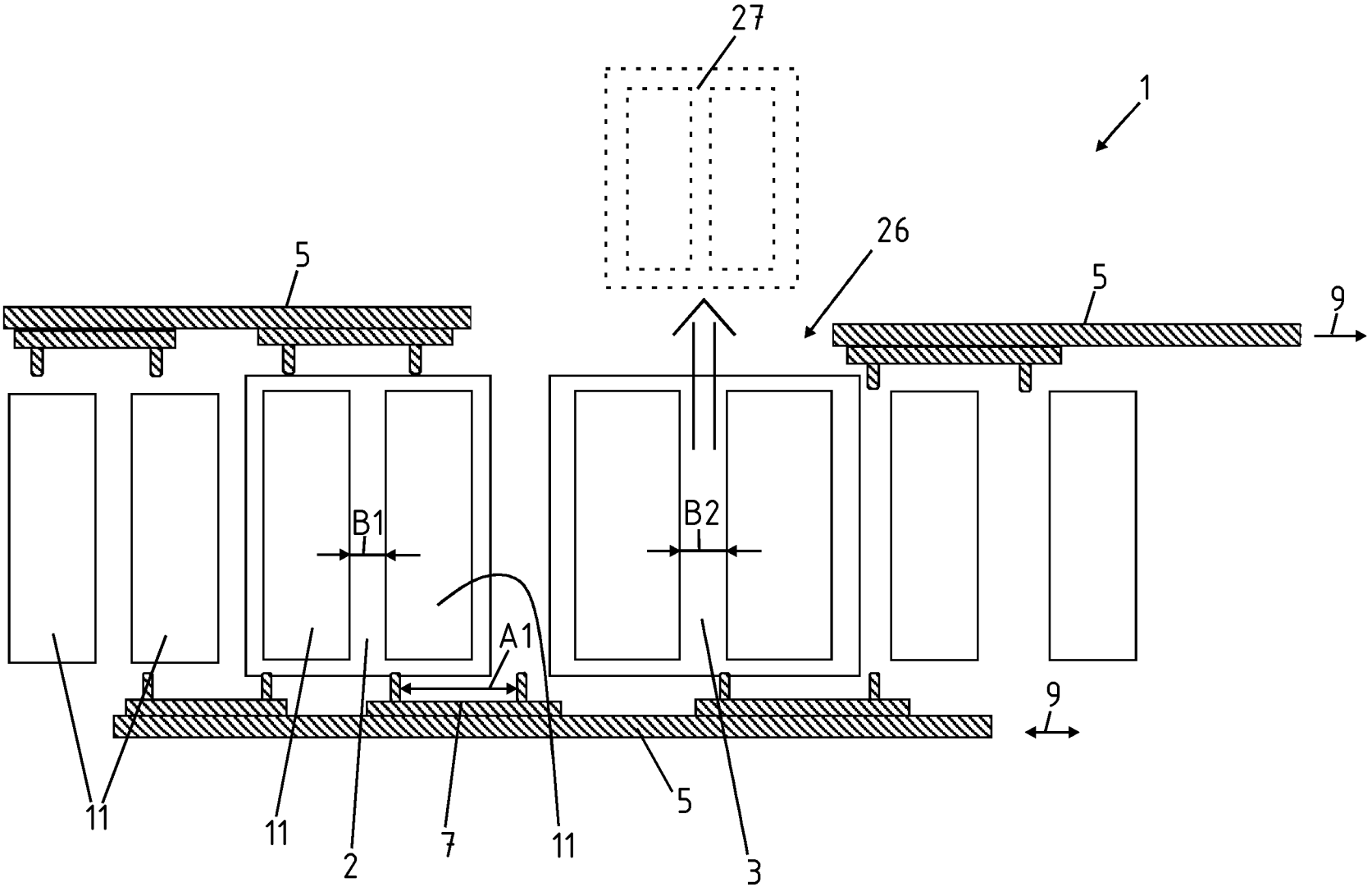
FIG. 10 shows a hot-forming line having a divisible rail.

FIG. 10 shows the hot-forming line 1 according to the invention in a resting state. The upper rail 5 in relation to the image plane, in the axial direction 9 of the former, is divided into two and outwardly displaced. On account thereof, free access 26 to the hot-forming and press-hardening tool 3 that is located therebehind is enabled such that a schematically indicated tool changeover 27 may take place. Subsequently thereto, the two rail parts are again converged, coupled to one another, and the hot-forming line 1 is operated.

It is furthermore illustrated that two gripper pairs which in relation to the image plane are disposed in the center and which in particular are temperature-control grippers 7, are variable in terms of the mutual spacing A1 thereof. On account thereof, it is possible for two temperature-controlled blanks to be received at a spacing B1 from the temperature-control station 21, and to be deposited in the hot-forming and press-hardening tool 24 at a spacing B2 by enlarging the mutual spacing A1 of the temperature-control grippers 7 in the axial direction 9 of the rails 5. Wherein, the spacing B2 is longer than the spacing B1.

Figure 11:
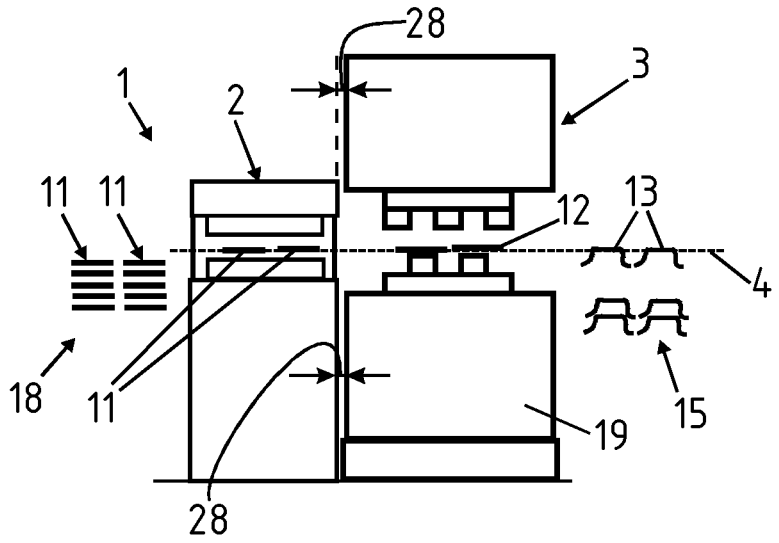
FIG. 11 shows a hot-forming line having a temperature-control station and a hot-forming and press-hardening tool, mutually spaced apart by less than 50 cm.

FIG. 11 shows a hot-forming line 1. The temperature-control station 2 and the hot-forming and press-hardening tool 3 are disposed so as to be tightly close to one another at a spacing 28 of less than 50 cm. The temperature-control station 2 and the hot-forming and press-hardening tool 3 may be driven in a synchronous manner. The may be performed by way of a common controller or by means of a superordinate controller of two connected individual controllers. A common opening phase is important, such that the linear conveyor system 4 may perform respective transportation in a short time.

The invention claimed is:

1. A hot-forming line for manufacturing hot-formed and press-hardened steel-sheet products, the hot-forming line comprising:

a temperature-control station for heating at least one metal blank;

a hot-forming and press-hardening tool;

a controller coupled to the temperature-control station and the hot-forming and press-hardening tool, and configured to actuate the temperature-control station and the hot-forming and press-hardening tool; and a linear conveyor system which is configured from at least two mutually opposite parallel rails provided along the hot-forming line, wherein the rails are displaceable in at least one translatory direction, and gripper elements disposed on the rails, wherein the gripper elements are displaceable in an axial direction of the rails, and the gripper elements are capable of being lifted and lowered in a manner orthogonal to the axial direction of the rails, wherein the controller is configured to actuate a vertical opening movement of the hot-forming and press-hardening tool, and actuate a vertical opening movement of the temperature-control station so as to be temporally delayed in relation to the vertical opening movement of the hot-forming and press-hardening tool, and the temperature-control station and the hot-forming and press-hardening tool are disposed so as to be directly next to one another at a spacing of less than 50 cm.

2. A hot-forming line according to claim 1,
wherein the gripper elements include active grippers configured to perform a clamping movement to acquire a metal blank.

3. A hot-forming line according to claim 2,
wherein the active grippers are configured as blank grippers and temperature control grippers.

4. A hot-forming line according to claim 1,
wherein the gripper elements include passive grippers which, by way of the steel-sheet product bearing thereon by virtue of the influence of gravity, are configured to perform a lifting function to acquire a finished steel-sheet product.

5. A hot-forming line according to claim 4,
wherein the passive grippers are configured as product grippers.

6. A hot-forming line according to claim 1, further comprising a synchronous drive,
wherein the rails are displaceable in a manner orthogonal to the axial direction thereof, and outwardly and inwardly, respectively, in relation to the hot-forming line, the synchronous drive.

7. A hot-forming line according to claim 1, further comprising a synchronous drive,
wherein all gripper elements are displaceable in the axial direction of the rails by the synchronous drive.

8. A hot-forming line according to claim 1,
wherein a translator displacement path of the gripper elements, orthogonally to the axial direction of the rails, from a resting position to a gripping position is between 5 and 250 mm.

9. A hot-forming line according to claim 1,
wherein the temperature-control station is fitted to the hot-forming and press-hardening tool.

10. A hot-forming line according to claim 1,
wherein the gripper elements include active grippers configured to perform a clamping movement
to simultaneously acquire two metal blanks that are simultaneously heatable, and
to simultaneously acquire two steel-sheet products that are simultaneously hot-formable and press-hardenable, such that the hot-forming line is configured to have dual parallel action.

11. A hot-forming line according to claim 1,
wherein all gripper elements are displaceable in the axial direction of the rails by a displacement of the rails.

12. A hot-forming line according to claim 1,
wherein a translator displacement path of the gripper elements, orthogonally to the axial direction of the rails, from a resting position to a gripping position is between 10 to 50 mm.

13. A hot-forming line according to claim 1,
wherein the temperature-control station and the hot-forming and press-hardening tool are disposed so as to be directly next to one another at a spacing equal to or less than 10 cm.

14. A method of operating a hot-forming line,
the hot-forming line comprising:
a temperature-control station;
a hot-forming and press-hardening tool;
a controller coupled to the temperature-control station and the hot-forming and press-hardening tool, and configured to actuate the temperature-control station and the hot-forming and press-hardening tool; and
a linear conveyor system which is configured from
at least two mutually opposite parallel rails provided along the hot-forming line, and
gripper elements disposed on the rails,
wherein
the rails are displaceable toward and away from each other,
the gripper elements are displaceable in an axial direction of the rails,
the gripper elements are configured to be lifted and lowered in a manner orthogonal to the axial direction of the rails, and
the gripper elements comprise two mutually opposite blank grippers, two mutually opposite temperature-control grippers, and two mutually opposite product grippers,
the method comprising:
acquiring at a blank metal by the two mutually opposite blank grippers;
acquiring a heated metal blank in the temperature-control station by the two mutually opposite temperature-control grippers;
acquiring at a formed and hardened steel sheet product in the hot-forming and press-hardening tool by the two mutually opposite product grippers;
actuating, by the controller, a vertical opening movement of the hot-forming and press-hardening tool;
actuating, by the controller, a vertical opening movement of the temperature-control station so as to be temporally delayed in relation to the vertical opening movement of the hot-forming and press-hardening tool; and
by an axial movement of the gripper elements along the axial direction of the rails, simultaneously
conveying the metal blank, by the two mutually opposite blank grippers, into the temperature-control station to deposit the metal blank therein,
conveying the heated metal blank, by the two mutually opposite temperature-control grippers, from the temperature control station into the hot-forming and press-hardening tool to deposit the heated metal blank therein, and
conveying the at formed and hardened steel sheet product, by the two mutually opposite product grippers, from the hot-forming and press-hardening tool to a depository stack,
wherein the temperature-control station and the hot-forming and press-hardening tool are disposed so as to be directly next to one another at a spacing of less than 50 cm.

15. The method according to claim 14, further comprising:
moving the rails inwardly toward each other orthogonally to the axial direction of the rails to
bring the two mutually opposite blank grippers into engagement with the blank metal in said acquiring the blank metal,
bring the two mutually opposite temperature-control grippers into engagement with the heated metal blank in said acquiring the heated metal blank, and
bring the two mutually opposite product grippers into engagement with the formed and hardened steel sheet product in said acquiring the formed and hardened steel sheet product; and moving the rails outwardly away from each other orthogonally to the axial direction of the rails to disengage the two mutually opposite blank grippers from the blank metal to deposit the blank metal in the temperature-control station, disengage the two mutually opposite temperature-control grippers from the heated metal blank to deposit the heated metal blank in the hot-forming and press-hardening tool, and disengage the two mutually opposite product grippers from the formed and hardened steel sheet product to deposit the formed and hardened steel sheet product at the depository stack.

16. A method of operating a hot-forming line, the hot-forming line comprising:

a temperature-control station;

a hot-forming and press-hardening tool; and a controller coupled to the temperature-control station and the hot-forming and press-hardening tool, and configured to actuate the temperature-control station and the hot-forming and press-hardening tool;

a linear conveyor system which is configured from two mutually opposite parallel rails provided along the hot-forming line, and gripper elements disposed on the rails, wherein the rails are displaceable toward and away from each other, the gripper elements are displaceable in an axial direction of the rails, the gripper elements are configured to be lifted and lowered in a manner orthogonal to the axial direction of the rails, and the gripper elements comprise two pairs of mutually opposite blank grippers, two pairs of mutually opposite temperature-control grippers, and two pairs of mutually opposite product grippers, the method comprising:

acquiring two blank metals by the two pairs of mutually opposite blank grippers;

acquiring two heated metal blanks in the temperature-control station by the two pairs of mutually opposite temperature-control grippers;

acquiring two formed and hardened steel sheet products in the hot-forming and press-hardening tool by the two pairs of mutually opposite product grippers;

actuating, by the controller, a vertical opening movement of the hot-forming and press-hardening tool;

actuating, by the controller, a vertical opening movement of the temperature-control station so as to be temporally delayed in relation to the vertical opening movement of the hot-forming and press-hardening tool; and by an axial movement of the gripper elements along the axial direction of the rails, simultaneously conveying the two metal blanks, by the two pairs of mutually opposite blank grippers, into the temperature-control station to deposit the two metal blanks therein, conveying the two heated metal blanks, by the two pairs of mutually opposite temperature-control grippers, from the temperature control station into the hot-forming and press-hardening tool to deposit the two heated metal blanks therein, and conveying the two formed and hardened steel sheet products, by the two pairs of mutually opposite product grippers, from the hot-forming and press-hardening tool to a depository stack, wherein the temperature-control station and the hot-forming and press-hardening tool are disposed so as to be directly next to one another at a spacing of less than 50 cm.

* * * * *